US008857080B1

(12) United States Patent
Sutter

(10) Patent No.: US 8,857,080 B1
(45) Date of Patent: Oct. 14, 2014

(54) TRANSFER BUCKET AND EJECTOR ASSEMBLY FOR A FRONT END LOADER VEHICLE

(76) Inventor: Frank J Sutter, Ft. Recovery, OH (US)

( * ) Notice: Subject to any disclaimer, the term of this patent is extended or adjusted under 35 U.S.C. 154(b) by 679 days.

(21) Appl. No.: 13/134,752

(22) Filed: Jun. 16, 2011

(51) Int. Cl.
*E02F 3/407* (2006.01)

(52) U.S. Cl.
CPC ..... *E02F 3/407* (2013.01)
USPC ..... 37/426; 414/704; 414/416.04

(58) Field of Classification Search
CPC B62B 1/145; B62B 2203/70; B62B 2203/72; B66F 9/19; B66F 9/195; E02F 3/407; E02F 3/6436; E02F 3/6481; E02F 3/656; Y10S 37/901
USPC ..... 37/416, 426, 431, 901; 414/280, 414/416.04, 416.09, 492, 509, 661, 667, 414/671, 704, 725, 785
See application file for complete search history.

(56) References Cited

U.S. PATENT DOCUMENTS

| | | | | | |
|---|---|---|---|---|---|
| 2,670,867 | A | * | 3/1954 | Thompson | 414/661 |
| 2,993,610 | A | * | 7/1961 | Kughler | 414/661 |
| 3,048,293 | A | * | 8/1962 | Cushman | 414/664 |
| 3,079,021 | A | | 2/1963 | Kohorst et al. | |
| 3,426,928 | A | | 2/1969 | Campbell | |
| 3,452,462 | A | * | 7/1969 | Martin | 37/431 |
| 3,458,075 | A | * | 7/1969 | Faust | 254/387 |
| 3,666,128 | A | * | 5/1972 | Shimizu | 414/661 |
| 3,675,803 | A | * | 7/1972 | Baughman | 414/668 |
| 3,788,507 | A | * | 1/1974 | Voss | 414/607 |
| 3,809,264 | A | * | 5/1974 | Mayers | 414/293 |
| 3,837,516 | A | | 9/1974 | Meyer | |
| 4,065,011 | A | * | 12/1977 | Teti | 414/725 |
| 4,284,384 | A | * | 8/1981 | Olson | 414/434 |
| 4,297,070 | A | * | 10/1981 | Didtel | 414/497 |
| 4,482,286 | A | * | 11/1984 | Farmer et al. | 414/607 |
| 4,861,223 | A | * | 8/1989 | Olson | 414/661 |
| 4,927,320 | A | * | 5/1990 | Olson | 414/814 |
| 5,009,562 | A | * | 4/1991 | Hosotani et al. | 414/440 |
| 5,169,278 | A | | 12/1992 | Hoechst et al. | |
| 5,577,873 | A | * | 11/1996 | Tanaka et al. | 414/400 |
| 5,603,382 | A | | 2/1997 | McIver | |
| 5,702,227 | A | | 12/1997 | Berg | |
| 6,729,830 | B2 | | 5/2004 | Wagner et al. | |
| 2013/0195592 | A1 | * | 8/2013 | Meijer | 414/661 |

* cited by examiner

*Primary Examiner* — Saul Rodriguez
*Assistant Examiner* — Brendan Tighe
(74) *Attorney, Agent, or Firm* — Jacox, Meckstroth & Jenkins

(57) ABSTRACT

A front end loader supports a bucket having opposite side walls connected by a bottom wall. An ejector plate is supported for movement within the bucket between a collapsed position and an extended position by a scissor mechanism including a set of parallel forward tracks secured to the ejector plate and a set of parallel rearward tracks secured to the bucket. Upper and lower sets of pivotally connected and crossing link members are connected to the tracks by pivots and rollers, and a hydraulic cylinder is positioned between the sets of link members and is pivotally connected to the rearward tracks and to the link members. A hydraulic booster cylinder initiates forward movement of the ejector plate from its collapsed position, and the side walls of the bucket have opposing guide rails which hold the ejector plate adjacent the bottom wall of the bucket.

7 Claims, 3 Drawing Sheets

TRANSFER BUCKET AND EJECTOR ASSEMBLY FOR A FRONT END LOADER VEHICLE

BACKGROUND OF THE INVENTION

In the art of front end loaders such as a skid-steered loader or tractor or other vehicle with a pair of pivotable arms, for example, as disclosed in U.S. Pat. No. 5,169,278 and No. 6,729,830, a bucket is commonly supported for vertical and tilting movement in front of the vehicle for transporting various articles or other materials from one location to another location, and frequently, the material is wet and/or sticky and is difficult to unload or eject from the bucket. For example, the material may be wet manure or wet sand or muddy soil. To solve the problem of unloading or ejecting such material, there have been various forms of unloading or ejecting devices either proposed or used, for example, as disclosed in U.S. Pat. No. 3,079,021, No. 3,426,928, No. 3,452,462, No. 3,837,516, No. 5,603,382 and No. 5,702,227.

In order to discharge or eject all types of materials from the bucket, it has been found desirable for the ejector plate to remain generally perpendicular to the bottom wall of the bucket while unloading or ejecting regardless of the position or angle of the bottom wall of the bucket. It is also been found desirable for the entire ejecting mechanism to be carried by the bucket and to be compact in a collapsed position of the ejector plate in order to optimize the capacity of the bucket and to minimize the overall depth and weight of the bucket and ejector assembly. This also permits the assembly to be conveniently used and attached to various vehicles including the front loader of a skid loader or lawn tractor. After reviewing the disclosures of the above-mentioned patents, it is apparent that none of the buckets and load ejecting systems provide all of the above desired features.

SUMMARY OF THE INVENTION

The present invention is directed to an improved transfer bucket and ejector assembly adapted to be mounted on a front end loader of a wheel or track supported vehicle and which is ideally suited for attachment to a front end loader of a vehicle such as the skid-steered loader or tractor disclosed in above-mentioned U.S. Pat. No. 5,169,278 and No. 6,729,830. In general, a transfer bucket and ejector assembly constructed in accordance with the invention includes a bucket having a bottom wall rigidly connecting opposite vertical side walls, and an attachment panel or member connects the rear portion of the bucket to the front end of a loader vehicle. A generally flat ejector plate is positioned within the bucket perpendicular to the bottom wall and is moved between a rearward and compact collapsed position and an extended forward discharge position for ejecting material from the bucket. A hydraulically actuated scissor mechanism is connected between the rear portion of the bucket and the ejector plate for moving the plate between the collapsed and discharge positions. The mechanism includes a set of vertically spaced parallel forward tracks connected to the ejector plate and a set of vertically spaced parallel rearward tracks extending parallel to the forward tracks and rigidly connected to the bucket. An upper set of pivotally connected and crossing elongated link members and a lower set of pivotally connected crossing elongated link members are spaced vertically, and each link member has one end portion pivotally connected to one of the tracks and an opposite end portion connected by a roller or bearing to another track. A hydraulic actuating cylinder unit is positioned between the upper set of link members and the lower set of link members and is pivotally connected to one pair of tracks and to one pair of link members for moving the ejector plate between its compact collapsed position and its extended forward ejecting or discharge position.

Other features and advantages of the invention will be apparent from the following description, the accompanying drawings and the appended claims.

DESCRIPTION OF THE PREFERRED EMBODIMENT

Figure 1:
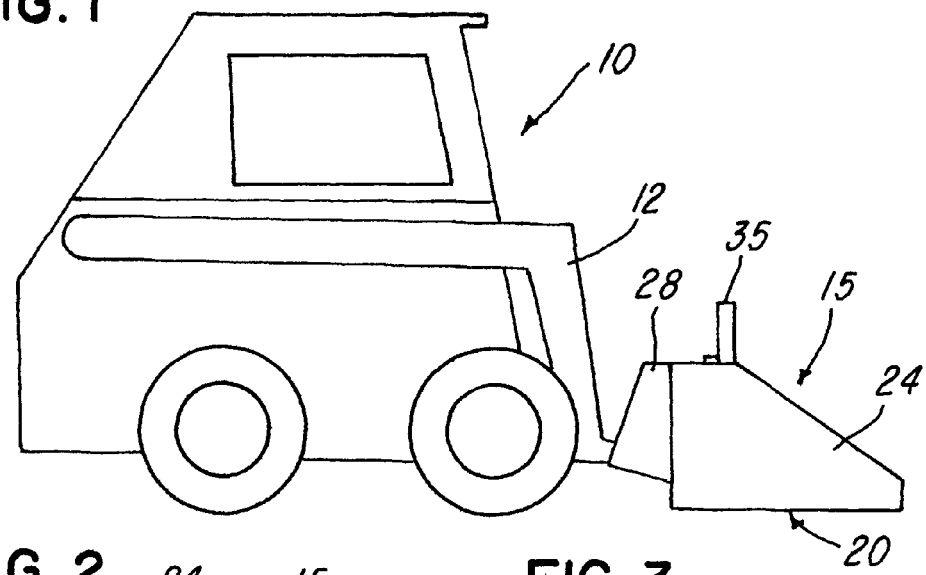
FIG. 1 is a side elevational view a skid loader having a transfer bucket and ejector assembly constructed in accordance with the invention.

FIG. 1 illustrates a skid-steer loader or skid loader 10 of the general type disclosed in above-mentioned U.S. Pat. No. 5,169,278, the disclosure of which is herein incorporated by reference. Skid loader 10 includes a pair of pivotally supported arms 12 which are hydraulically actuated and which support a transfer bucket and ejector assembly 15 constructed in accordance with the present invention. Referring to FIGS. 2-7, the assembly 15 includes a steel fabricated bucket 20 having a flat bottom wall 22 rigidly connecting opposite vertical side walls 24 which are also rigidly connected by horizontally and vertically extending rear frame members 26 and 27 (FIGS. 6 & 7) in the form of steel tubes welded at the corners. The frame members 26 also support an inclined mounting or attachment panel 28 which is constructed in a conventional manner and latches onto a tiltable plate of the loader to provide for releasably and quickly attaching the bucket assembly 15 to the arms 12 of the front end skid loader 10.

In accordance with the present invention, the bucket and ejector assembly 15 includes a fabricated ejector panel or plate 35 having a forwardly projecting flange portion 36 extending around the upper and side portions of the plate 35. As shown in FIG. 7, an upper portion of the ejector plate 35 has horizontally spaced openings 41, 42 and 43 which may be covered by a wire mesh and provide the operator of the skid loader 10 a better view of the material being transferred by the bucket 20. As shown in FIGS. 2-6, the ejector plate 35 is moved between a fully retracted position (FIGS. 2 & 5) and a fully extended discharge position (FIGS. 4 & 6) by a hydraulically actuated scissor mechanism 50 which includes a set of vertically spaced and parallel horizontal guide members or tracks 52 welded to the back of the plate 35. The tracks 52 extend between the side walls 24 of the bucket 20 and define vertically spaced and opposing guideways 54. Another set of vertically spaced elongated guide members or tracks 58 have opposite end portions rigidly secured or welded to the vertical frame members 26 and define horizontally extending guideways which face upwardly and downwardly in opposite directions at the rear of the bucket 20.

Figure 4:
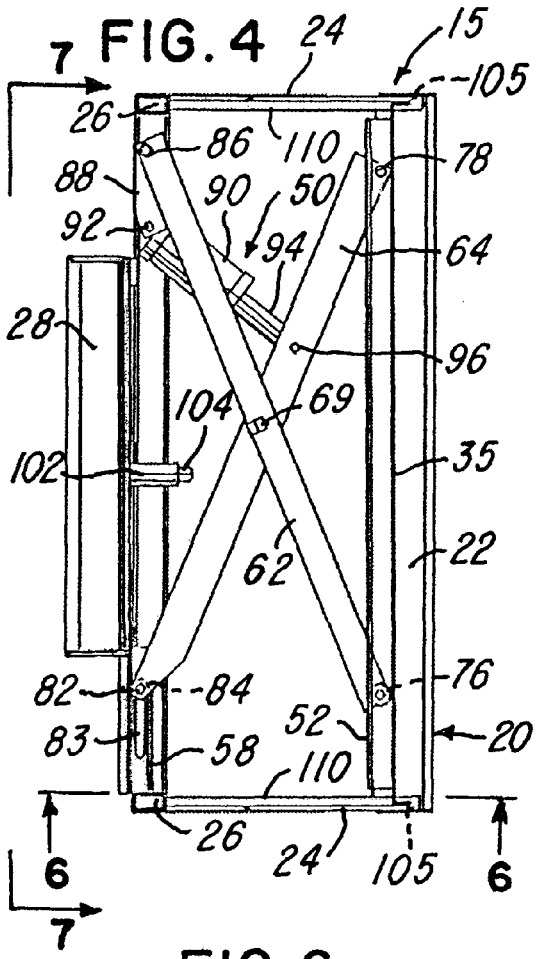
FIG. 4 is a horizontal section of the assembly and showing the ejector plate in its fully extended forward position.
Figure 5:
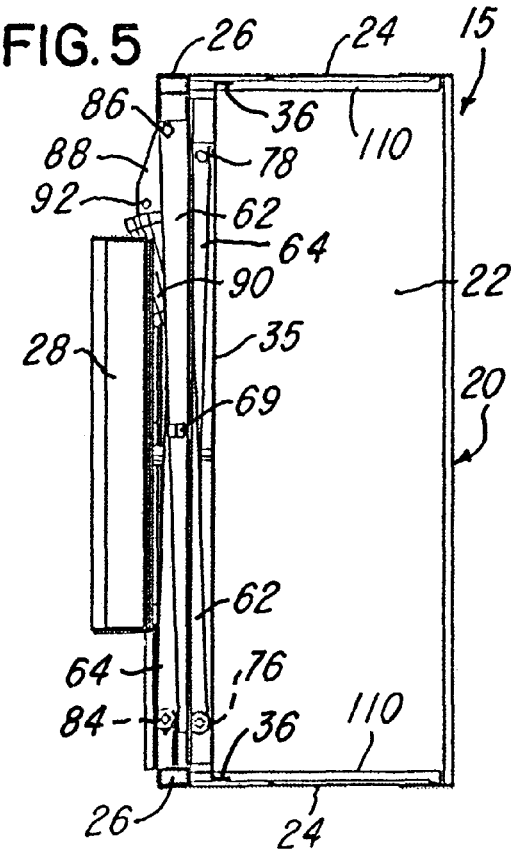
FIG. 5 is section similar to FIG. 4 and showing the ejector plate in its fully retracted collapsed position.

The scissor mechanism 50 also includes an outer pair of vertically spaced and pivotally connected crossing elongated link members 62 and an inner pair of pivotally connected and crossing link members 64 all of which are all pivotally connected by a vertical rod or pivot shaft 68 secured by a top plate member 69. The forward end portions of outer pair of link members 62 are rigidly connected by a vertical shaft 74 (FIG. 6) which has an upper end portion and a lower end portion supporting wheels or bearings 76 within the corresponding tracks 52 for linear movement within the tracks. The forward end portions of the inner pair of inner link members 64 are pivotally connected to the tracks 52 by a vertically extending pivot shaft 78 (FIGS. 4 & 5).

Figure 6:
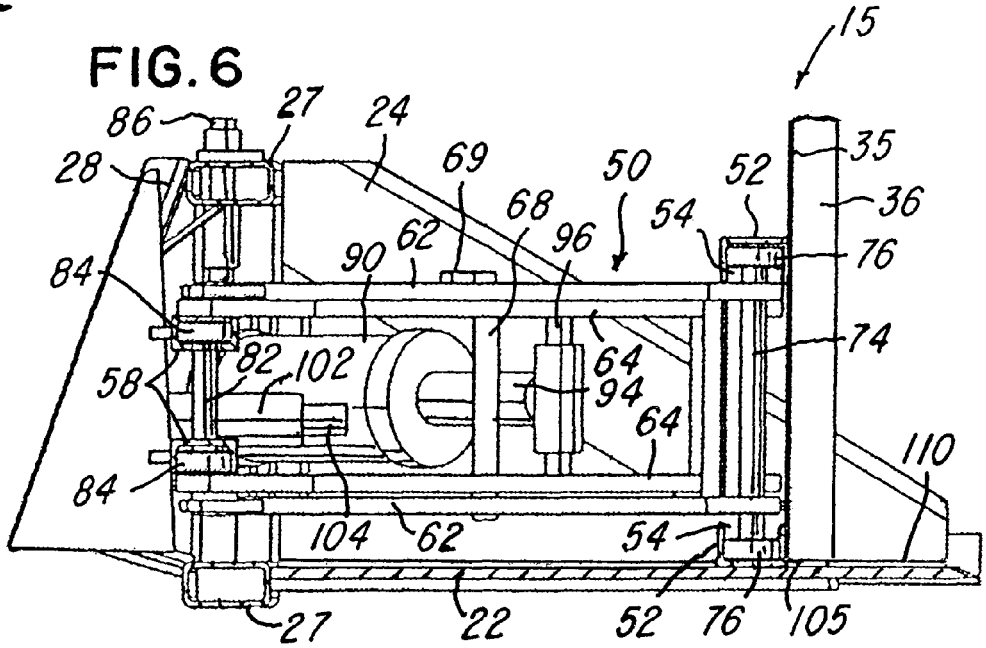
FIG. 6 is an enlarged vertical section of the assembly, taken generally on the line 6-6 of FIG. 4.
Figure 7:
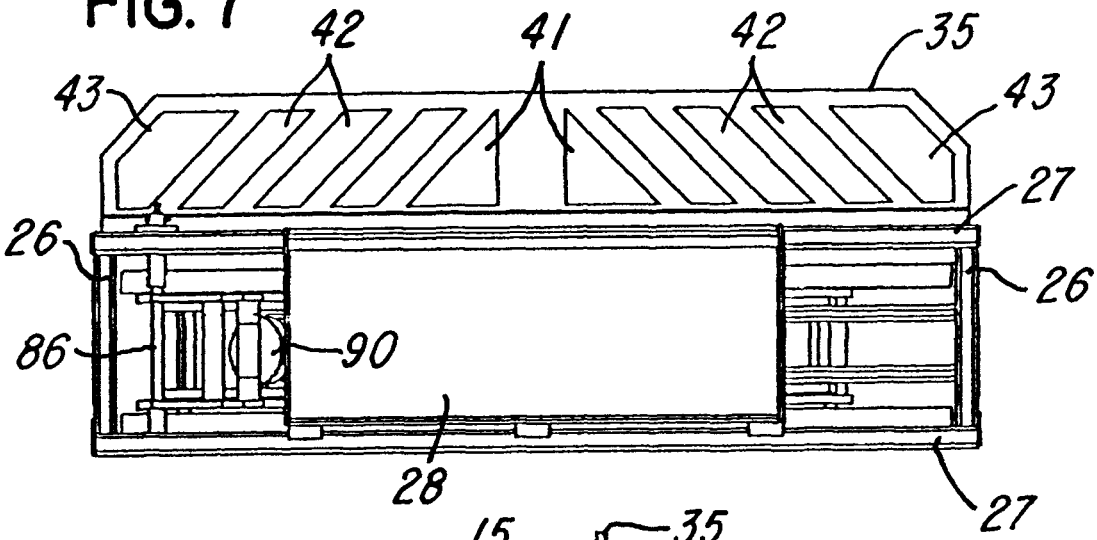
FIG. 7 is a rear view of the bucket and ejector assembly, taken generally on the line 7-7 of FIG. 4.

The rearward end portions of the inner pair of link members 64 are connected by a vertical shaft 82 (FIG. 6) which extends through slots 83 (FIG. 4) within the tracks 58 and supports a pair of wheels or bearings 84 within the tracks 58, as shown in FIG. 6. The rearward end portions of the outer pair of link members 62 are rigidly connected by a vertical pivot shaft 86 which extends through holes within the horizontal frame members 27 and the upper and lower tracks 58. A pair of vertically spaced brackets 88 (FIG. 4) are rigidly secured to the inner end portions of the link member 62 and pivotally support a hydraulic cylinder 90 on a pivot pin 92. The cylinder 90 has a piston rod 94 which is pivotally connected to the inner set or pair of link members 64 by a vertical pivot shaft or pin 96 having opposite end portions rigidly secured to the inner link members 64. A substantially smaller hydraulic booster cylinder 102 is supported by the attachment panel 28 and has a forwardly projecting piston rod 104 positioned to engage a block member (not shown) rigidly connected to the back of the ejector plate 35.

Figure 2:
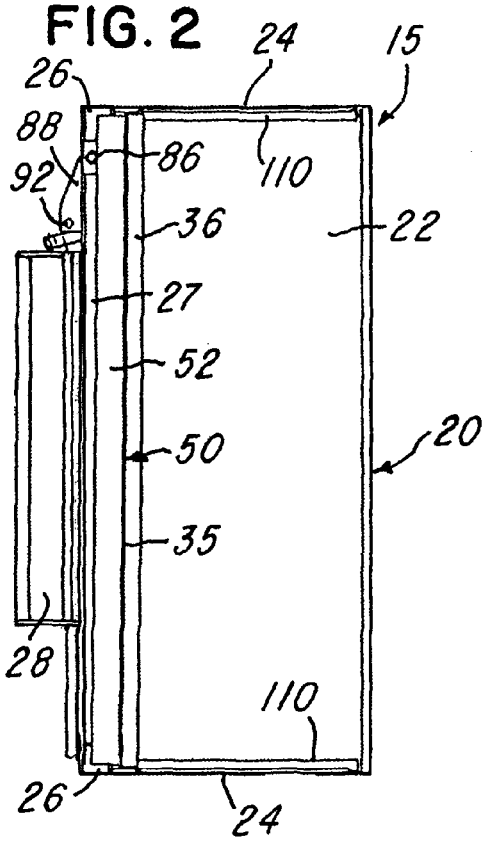
FIG. 2 is a top plan view of the bucket and ejector assembly with the ejector plate in its collapsed position.
Figure 3:
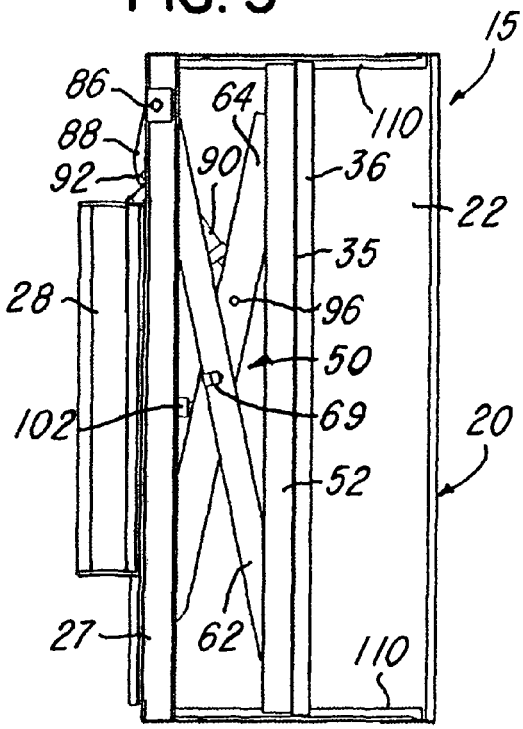
FIG. 3 is a plan view similar to FIG. 2 and with the ejector plate in a partially extended position.

In operation, the hydraulic cylinders 90 and 102 are controlled by valves located within the skid loader 10 for moving the ejector panel or plate 35 between its fully retracted and collapsed position (FIGS. 2 & 5) and its fully extended and ejecting discharge position (FIGS. 4, 6) primarily by actuating the cylinder 90. As shown in FIGS. 2 & 5, when the ejector plate is in its retracted fully collapsed position, the scissor mechanism 50 is compact and requires only a little space of approximately four inches added to the bucket 20. If the load to be discharged is extra heavy or difficult to move, the hydraulic booster cylinder 102 is actuated to start movement of the ejector plate 35 towards its extended position. After the ejector plate has partially moved toward the extended discharge position (FIG. 3), the main or primary hydraulic cylinder 90 provides sufficient force to move the ejector plate 35 and the load to its fully discharged position, as shown in FIGS. 4 & 6.

Figure 8:
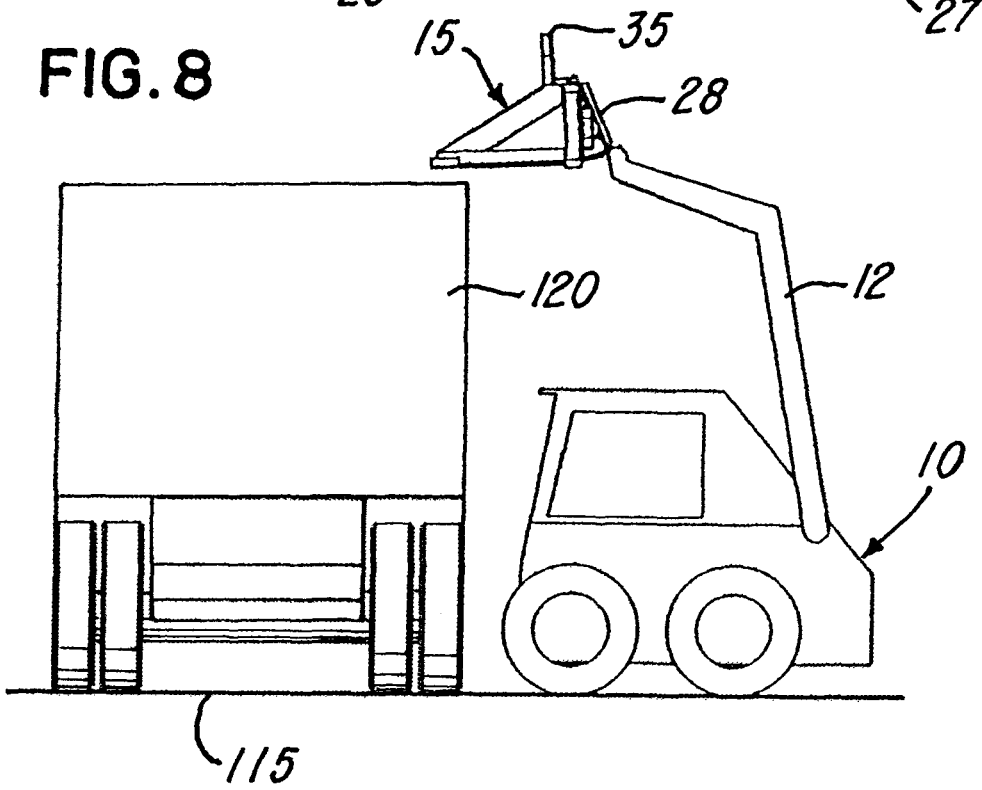
FIG. 8 is an elevational view of the skid loader shown in FIG. 1 with an elevated bucket and ejector assembly constructed in accordance with FIGS. 2-7 for transferring and ejecting a load into a dump truck.

When the ejector plate 35 moves between its collapsed position and the fully extended position, bottom flanges 105 project laterally outwardly from opposite bottom edges of the ejector plate under guide ribs or rails 110 which project inwardly from the side walls 24 of the bucket slightly above the bottom wall of the bucket. This interfitting sliding connection assures that the ejector plate 35 and actuating scissor mechanism 50 remain in the position shown in FIG. 6, with the ejector plate 35 perpendicular to the bottom wall 22, and the plate does not raise or tilt upwardly from the bottom wall 22 during movement. As illustrated in FIG. 8, the tilting bucket and ejector assembly 15 is elevated by the arms 12 of the skid loader 10 from a lower position adjacent the ground or roadbed 115 town elevated position where a wet load may be ejected horizontally or downwardly into the container of a dump truck 120.

From the drawings and the above description, it is apparent that a bucket and ejector assembly constructed in accordance with the invention provides desirable features and advantages. As a primary feature, the ejector plate 35 and the hydraulically actuated scissor mechanism 50 for moving the ejector plate 35 are compact in their collapsed position and occupy only a few inches. As a result, the capacity of the bucket 20 is not significantly reduced or the depth of the bucket is not significantly increased. Another advantage of the assembly 15 is that the bucket may be used to transport a pallet loaded with a supply of materials such as bricks or blocks, and the perpendicular ejector plate 35 and scissor mechanism 50 are effective to push or slide the loaded pallet from the bottom wall 22 of the bucket 10 without shifting or dumping the load on the pallet. The ejector plate 35 and scissor mechanism 50 are also especially effective in discharging a wet or sticky material such as wet manure or wet sand or wet soil from the bucket 20. The discharge may also be at any angle of the bottom wall 22 of the bucket 20 with respect to a horizontal or level position.

While the form of bucket and ejector assembly herein described constitutes a preferred embodiment of the invention, it is to be understood that the invention is not limited to this precise form of the invention, and that changes made therein without departing from the scope and spirit of the invention as defined in the appended claims.

What is claimed is:

1. In combination with a front end skid loader vehicle having pivotally supported side arms pivotally connected to a bucket having a bottom wall rigidly connecting opposite vertical side walls, the improvement comprising an ejector assembly located within said bucket and including an ejector plate positioned substantially perpendicular to said bottom wall, said ejector plate extending between said side wall for movement parallel to said bottom wall and between a rearward collapsed position and a forward discharge position, a set of vertically spaced elongated forward tracks rigidly connected to said ejector plate and extending horizontally between said side walls parallel to said bottom wall of said bucket, a set of vertically spaced rearward tracks extending horizontally parallel to said forward tracks and rigidly connected to said bucket, a scissor mechanism including an upper set of pivotally connected and crossing link members and a lower set of pivotally connected and crossing link members with said lower set of crossing link members spaced below said upper set of said crossing link members and with each set of crossing link members extending parallel to said bottom wall of said bucket, each said set of crossing link members having end portions pivotally connected to said forward tracks and to said rearward tracks and opposite end portions connected for linear movement on said forward tracks and said rearward tracks, and a hydraulic cylinder unit extending within a space between said upper set of crossing link members and said lower set of crossing link members in parallel relation to said bottom wall of said bucket and pivotally connected to said rearward tracks and pivotally connected to each said set of crossing link members.

2. The combination as defined in claim 1 wherein said hydraulic cylinder unit extends parallel to said bottom wall between said rearward tracks and between said upper set and said lower set of crossing link members when said ejector plate is in said collapsed position.

3. The combination as defined in claim 1 wherein said forward set of tracks comprise channel members defining vertically spaced and opposing elongated guideways receiving rollers connected to said link members.

4. The combination as defined in claim 1 wherein said rearward set of parallel tracks comprise channel members defining vertically spaced elongated guideways facing upwardly and downwardly and receiving rollers connected to said link members.

5. The combination as defined in claim 1 and including a hydraulic booster cylinder unit connected to said bucket and positioned to initiate movement of said ejector plate from said collapsed position toward said discharge position.

6. The combination as defined in claim 1 and including an attachment panel rigidly connected to said bucket and said rearward tracks, and said panel is inclined relative to said bottom wall and adapted to receive an attachment mechanism mounted on said arms of said loader vehicle.

7. The combination as defined in claim 1 wherein said ejector plate in said rearward collapsed position is substantially parallel to each said set of crossing link members and said rearward tracks to form a compact arrangement of said ejector plate, said tracks and said link members within said bucket.

* * * * *